United States Patent [19]

Garg

[11] 4,441,983

[45] Apr. 10, 1984

[54] ZINC SULFIDE LIQUEFACTION CATALYST

[75] Inventor: Diwakar Garg, Macungie, Pa.

[73] Assignee: Air Products and Chemicals, Inc., Allentown, Pa.

[21] Appl. No.: 409,469

[22] Filed: Aug. 19, 1982

[51] Int. Cl.[3] ..... C10G 1/08

[52] U.S. Cl. ..... 208/10; 502/216; 502/343

[58] Field of Search ..... 208/10; 252/475, 439

[56] References Cited

U.S. PATENT DOCUMENTS

| | | | |
|---|---|---|---|
| 1,946,341 | 2/1934 | Szeszich | 196/53 |
| 2,038,599 | 4/1936 | Pier et al. | 208/10 |
| 2,227,672 | 1/1941 | Pier et al. | 196/53 |
| 2,402,694 | 6/1946 | Tanner | 260/609 |
| 2,753,296 | 7/1956 | Sellers | 208/10 |
| 3,502,564 | 3/1970 | Hodgson | 208/9 |
| 3,563,912 | 2/1971 | Young | 252/439 |
| 4,013,545 | 3/1977 | Hilfman | 208/111 |

OTHER PUBLICATIONS

Chemistry of Coal Utilization, vol. 1, Pt. 2, New York–John Wiley & Sons, Inc., 1945.

Kirk–Othmer Encyclopedia of Chemical Tech. Suppliment Volume.

*Primary Examiner*—Delbert E. Gantz

*Assistant Examiner*—Lance Johnson

*Attorney, Agent, or Firm*—Geoffrey L. Chase; E. Eugene Innis; James C. Simmons

[57] ABSTRACT

A process for the liquefaction of carbonaceous material, such as coal, is set forth wherein coal is liquefied in a catalytic solvent refining reaction wherein an activated zinc sulfide catalyst is utilized which is activated by hydrogenation in a coal derived process solvent in the absence of coal.

6 Claims, No Drawings

ZINC SULFIDE LIQUEFACTION CATALYST

TECHNICAL FIELD

The Government of the United States of America has rights in this invention pursuant to Contract No. DE-AC22-79ET14806 awarded by the U.S. Department of Energy. The present invention is directed to the field of catalyzed carbonaceous material liquefaction. More specifically, the present invention is directed to the liquefaction of coals such as bituminous coal and lignite. The present invention is concerned with the production of liquid products and refined solid carbon products from such coal.

BACKGROUND OF THE PRIOR ART

The liquefaction of solid carbonaceous material, such as coal, in the presence of a solvent has been practiced since the early years of the twentieth century. Such liquefaction or solvent refining process has been performed predominently on a non-commercial basis due to the expense of performing the process to derive utilizable liquid and solid fuels and because of the relatively less expensive availability of liquid fuels from petroleum. Large scale production of liquefied fuels from coal was performed in Germany when petroleum was unavailable to that country during the war years.

With the increasing expense and scarcity of petroleum and the liquid fuels derived therefrom, increased interest in the liquefaction or solvent refining of solid carbonaceous materials, such as coal, to liquid and solid refined products has occurred. However, the technical difficulties in achieving high yields of liquid products from coal at relatively economical rates has still presented a problem for those in the art. The most popular solution to the production of high yields of the desired liquid products from solid carbonaceous material, such as coal, has been the use of metal catalysts such as molybdenum, cobalt, nickel, tungstun oxides and sulfides. Such catalysts improve the proportion of liquid product as well as the overall conversion of coal to solid refined products, known as solvent refined coal (SRC) and oils. However, these metal catalysts are expensive and constitute an undesirable increase in the cost of liquid fuel production from solid carbonaceous material or coal. This is particularly true of coal conversion reactions wherein increased carbon fouling and metal and sulfide contamination of catalysts over that expected in petroleum refining occurs, with the resulting effect of diminishing the effective life of the catalyst in the reaction zone. This requires either the regeneration of the fouled metal catalysts or the disposal of the catalyst and the replacement of the same with additional fresh catalyst. When such expensive metal catalysts are utilized, both of these modes of operating the catalyzed reaction of coal are deemed to be undesirable from an economic point of view when operating the coal liquefaction process in a commercial manner wherein the resulting liquid product must be competitive with the remaining petroleum products still presently available. One alternate solution to this problem has been to utilize inexpensive coal liquefaction catalysts which can be thrown away after their effective catalytic life has expired without adversely affecting the economic operation of a commercially run coal liquefaction process. The difficulty in this solution is that many relatively inexpensive catalysts do no have significant or desirable levels of catalytic activity for the liquefaction of coal or other solid carbonaceous material. Because of this drawback, yet another attempt at a solution to the creation of an economic and efficient liquefaction process has been the combination of relatively inexpensive catalysts with small amounts of expensive catalysts.

For example, in U.S. Pat. No. 1,946,341, the hydrogenation of petroleum and coal tars in the presence of hydrogen sulfide and a metal sulfide catalyst, such as iron, cobalt or nickel sulfide is set forth.

Alternately, in U.S. Pat. No. 2,227,672, a process for the thermal treatment of carbonaceous materials, such as oil or coal is set forth wherein a co-catalyst system is utilized. Preferably, a large proportion of inexpensive catalyst of low activity is combined with a small proportion of a relatively expensive catalyst of high activity. The inexpensive catalysts include various metal sulfides such as ferrous, manganous and zinc sulfides. The expensive catalyst are generally chosen from the disulfides of tungsten, molybdenum, cobalt and nickel. Such catalysts can be supported on a carrier and activated by various acid treatments or gas treatments such as hydrogen contact. Such catalysts can be utilized for the destructive hydrogenation of coal as recited in the text of the patent.

In U.S. Pat. No. 2,402,694, the use of iron sulfide catalysts is recited for the production of thiols, wherein the iron sulfide catalyst is first made more active by gas phase hydrogenation at high temperatures.

In U.S. Pat. No. 3,502,564, a metal sulfide catalyst, such as nickel, tin, molybdenum, cobalt, iron or vanadium, is taught as a catalyst for coal liquefaction. The sulfide catalyst is formed in-situ on the coal by the reaction of a metal salt with hydrogen sulfide.

Additionally, U.S. Pat. No. 4,013,545 teaches the hydrogenation and sulfiding of an oxidized metal of Group VIII in order to form a hydrocracker catalyst for oils.

Despite these efforts, the prior art has failed to provide an inexpensive, throw-away or once-through catalyst which has increased activity for the production of liquid products from the liquefaction or solvent refining of solid carbonaceous material, such as coal.

BRIEF SUMMARY OF THE INVENTION

The present invention comprises a process for the liquefaction or solvent refining of solid carbonaceous material, such as coal, at elevated temperature and pressure in the presence of a solvent for the carbonaceous material or coal, hydrogen and a hydrogenation catalyst in order to produce predominently liquid products or oils and a solid refined product, generally known as solvent refined coal (SRC), wherein the improvement comprises conducting the liquefaction or solvent refining reaction in the presence of an activated zinc sulfide hydrogenation catalyst in which the zinc sulfide catalyst is activated prior to utilization by subjecting it to hydrogen gas, elevated temperature and a process solvent in the absence of the carbonaceous or coal feed material. The activation stage is performed under conditions approximating the coal liquefaction or solvent refining conditions, but absent the carbonaceous or coal feed material.

An advantage of the present invention is the utilization of a zinc sulfide catalyst which consists of the mineral sphalerite.

Preferably, the activation stage is performed in the presence of additional sulfides in order to avoid the reduction of the zinc sulfide during the activation sequence.

DETAILED DESCRIPTION OF THE INVENTION

The present invention, in which a pretreated, activated zinc sulfide catalyst is utilized in a liquefaction or solvent refining process, is relevant to the production of liquid fuels from any number of solid carbonaceous materials. Such materials include bituminous coal, lignite, peat and other organic matter. Preferably, this unique catalyst is utilized in the liquefaction or solvent refining of coal to provide liquid fuels or oils and solid refined coal material, which is referred to as solvent refined coal (SRC). This activated catalyst can be utilized in various catalyzed coal liquefaction processes, such as a slurry phase liquefaction process, an ebullated bed liquefaction process or a batch liquefaction process.

The process of the present invention, in which an activated zinc sulfide catalyst is utilized in a coal liquefaction process, is susceptible of operation at a wide variation in the coal liquefaction process parameters. For instance, the temperature of the liquefaction reaction may be from 650° to 900° F. The pressure of the liquefaction reaction can be maintained from 500 to 4000 psig. The solvent to coal ratio may vary from 80/20 wt % to 60/40 wt %. Finally, the activated zinc sulfide catalyst may be utilized in the coal liquefaction reaction in a range of 0.1 wt % to 10.0 wt %.

The zinc sulfide utilized in the process of the present invention can be pure zinc sulfide of a reagent quality or it may be a beneficiated ore, which is sometimes referred to as a concentrate. This form of the zinc sulfide is normally in the sphalerite form in which a certain minor proportion of the zinc atoms of the zinc sulfide molecule are replaced with iron. Sphalerite provides a readily available source of zinc sulfide at low cost such that the catalyst may be disposed of after it has become deactivated in duty in the coal liquefaction process.

The activation stage of the zinc sulfide is performed under conditions which approximate the coal liquefaction conditions, but in the absence of a coal or carbonaceous material feedstock. The zinc sulfide is generally provided in a particulate form which can range in size from 100 to 400 mesh. Alternately, the zinc sulfide catalyst could be supported on an inert carrier. The catalyst is placed in process solvent in a proportion of 1 wt % to 50 wt % catalyst. The process solvent may be any solvent known to be compatible with a coal liquefaction reaction scheme, such as creosote oil, internally generated coal derived solvent, solvent taken from a hydrotreating process, petroleum derived solvent or a hydrogen donor solvent such as tetralin or naphthalene. The appropriate solvent should have a boiling point of approximately 420° F. or greater. Preferably, the solvent will be the same solvent as is utilized in the coal liquefaction process itself. However, the solvent utilized in the preactivation of the zinc sulfide catalyst does not have to be the same solvent which is utilized in the coal liquefaction reaction.

The activation of the zinc sulfide is dependent upon the development of a hydrogenation atmosphere while the catalyst is at elevated temperature in the presence of the process solvent. Therefore, a hydrogen pressure in the range of 50 to 5000 psig is necessary in order for this increased activity to be produced in the treated catalyst. In addition, it is preferred to have at least some additional organic sulfur compounds present in the process solvent during activation in order to guard against the reduction of the zinc catalyst during the hydrogenation thereof. Activation is dependent upon the hydrogen pressure and the temperature during activation, but additionally the activation should be performed with a residence time in the range of from 5 to 60 minutes. The temperature should be in the range of 500° to 900° F.

When the zinc sulfide has been activated, the activated catalyst and process solvent may be directly added to the coal feed material and additional process solvent added until the desired feed slurry is present for coal liquefaction, or the activated catalyst may be separated from the solvent used during activation and the separated catalyst added independently into a process solvent and coal feed slurry which is the influent for a coal liquefaction process.

Although the results of this unique activation of zinc sulfide for a coal liquefaction process are readily recognizable from the experiments which follow, the exact theory as to why the catalyst achieves such increased activity after treatment in the presence of hydrogen in process solvent are unknown. However, the inventor has observed that the surface area of the catalyst is increased dramatically after the activation. Specifically, during measurements of the surface area, the zinc sulfide prior to activation was ascertained to have a surface area of 1.1 $m^2/g$, whereas the activated zinc sulfide had a surface area of 4.9 $m^2/g$. The increase in surface area would appear to account for at least some aspect of the increased activity of this catalyst for this particular reaction. However, it is believed that additional rearrangement of the structure of the zinc sulfide concentrate occurs as shown by x-ray diffraction analysis during the pretreatment and activation step, which results in a very active zinc sulfide catalyst for coal liquefaction. The zinc sulfide concentrate used in the examples in its untreated state was identified as having an essentially sphalerite structure. After treatment, the x-ray analysis showed that the major phase remained sphalerite, but a minor phase existed having a pyrrhotite and triolite structure.

The following specific examples demonstrate the unexpected activity of zinc sulfide and more particularly sphalerite when it is treated with hydrogen in the presence of process solvent. The examples show dramatic results when compared to unactivated zinc sulfide, particularly with respect to the desired production of liquid product, namely oils, from the coal feedstock. Although these examples are performed with a particular coal starting material, it is contemplated that the liquefaction process utilizing the activated catalyst of the present invention is relevant to other carbonaceous materials which are susceptible to liquefaction reactions.

The following specific examples show the advantage of using the activated catalyst of the present invention. The coal conversion and more importantly the oil production resulting from the addition of activated zinc sulfide concentrate to a coal liquefaction reaction is shown. The comparative data with the uncatalyzed reaction and zinc sulfide which has not been activated, regardless of temperature, concentration or specific coal is also shown and indicates that the activated zinc sulfide provides unexpected improvement in the catalytic activity of this catalyst species in a coal liquefaction reaction.

EXAMPLE 1

This example illustrates the activation procedure of the catalyst. The reaction mixture was comprised of zinc sulfide concentrate having a composition shown in Table 1 and a process solvent having the elemental composition and boiling point distribution shown in Tables 2 and 3, respectively. A reaction mixture (10 wt % zinc sulfide concentrate+90 wt % solvent) was passed into a one-litre continuous stirred tank reactor at a total pressure of 2000 psig and a hydrogen flow rate of 1.33 wt % of solvent. The reaction temperature was 850° F. and the nominal residence time was 40 minutes. The reaction product was filtered to recover the activated zinc sulfide catalyst. The x-ray diffraction analysis of the activated catalyst indicated that the sphalerite structure of the catalyst was affected by the activation wherein some minor phase changes occurred as stated above, and the surface area of the catalyst was increased substantially.

TABLE 1

| | Weight % |
|---|---|
| Chemical Analysis of Zinc Sulfide | |
| Zn | 62.6 |
| S | 31.2 |
| Pb | 0.54 |
| Cu | 0.21 |
| Fe | 1.0 |
| CaO | 0.28 |
| MgO | 0.14 |
| $SiO_2$ | 2.45 |
| $Al_2O_3$ | 0.03 |
| X-Ray Diffraction Analysis | |
| ZnS, FeS (sphalerite type structure) | |

TABLE 2

| Analysis of the Process System | Weight % |
|---|---|
| Fraction | |
| Oil | 93.8 |
| Asphaltene | 5.0 |
| Preasphaltene | 0.4 |
| Residue | 0.8 |
| Element | |
| Carbon | 89.44 |
| Hydrogen | 7.21 |
| Oxygen | 1.70 |
| Nitrogen | 1.10 |
| Sulfur | 0.55 |

TABLE 3

| GC Simulated Distillation of Process Solvent | |
|---|---|
| Weight % Off | Temperature °F. |
| I.B.P. | 519 |
| 5 | 548 |
| 6 | 552 |
| 10 | 569 |
| 20 | 590 |
| 30 | 607 |
| 40 | 627 |
| 50 | 648 |
| 60 | 673 |
| 70 | 699 |
| 80 | 732 |
| 90 | 788 |
| 95 | 835 |
| 97 | 845 |
| 99 | 898 |
| F.B.P. | 911 |

EXAMPLE 2

In this example, the reaction of coal without catalyst is shown. A 3g sample of Kentucky Elkhorn #3 coal having the composition shown in Table 4 was charged to a tubing-bomb reactor having a volume of 46.3 ml. A 6 g quantity of solvent, having similar elemental and boiling distributions as used in Example 1 was then added to the reactor. The reactor was sealed, pressurized with hydrogen to 1250 psig at room temperature and heated at 850° F. for 60 minutes. It was then agitated at 860 strokes per minute for the entire reaction period. After cooling the reaction product was analyzed to give a product distribution as shown in Table 5. The conversion was 77% based on maf coal, and the oil yield was 16% of feed maf coal.

EXAMPLE 3

This example illustrates the catalytic effect of unactivated zinc sulfide concentrate. To the reactor described in Example 2 was added 3 g of the coal used in Example 2 and 6 g sample of the solvent also used in Example 2. In addition, a 1 g sample of unactivated zinc sulfide concentrate described in Table 1 was also added. The reaction and product analysis was carried out in the same way as described in Example 2. Conversion was 84% of the feed maf coal and the corresponding oil yield was 27% maf coal as shown in Table 5, which exceeded the conversion and oil yields of Example 2 by a significant margin.

EXAMPLE 4

In this sample the activated zinc sulfide concentrate was utilized in a coal liquefaction reaction. To the reactor described in Example 2 was added 3 g of coal and 6 g of solvent of Example 2. In addition, 1 g of activated zinc sulfide described in Example 1 was added to the reactor. The reaction and product analysis were identical to the method used in Example 2. Results are shown in Table 5. The conversion of maf coal was 96% and the yield of oil was 41% maf. Both values were significantly higher than for the no-catalyst reaction in Example 2 and for the unactivated zinc sulfide concentrate reaction in Example 3.

TABLE 4

| Analysis of Elkhorn #3 Coal | Weight % |
|---|---|
| Proximate Analysis | |
| Moisture | 1.81 ± 0.03 |
| Volatile | 37.56 ± 0.10 |
| Fixed Carbon | 46.03 |
| Dry Ash | 14.60 ± 0.02 |
| Ultimate Analysis | |
| C | 69.40 |
| H | 4.88 |
| N | 1.00 |
| S | 1.94 |
| O (by difference) | 8.18 |
| Distribution of Sulfur | |
| Total Sulfur | 1.94 |
| Sulfate Sulfur | 0.04 |
| Pyrite Sulfur | 1.19 |
| Organic Sulfur | 0.75 |

EXAMPLE 5

This example illustrates the reaction of coal without any additives. The feed slurry was comprised of Kentucky Elkhorn #3 coal having the composition shown in Table 4 and a process solvent having the elemental composition and boiling point distribution shown in Tables 2 and 3, respectively. A coal oil slurry (70 wt % solvent+30 wt % coal) was passed into a one-litre continuous stirred tank reactor at a total pressure of 2000 psig and a hydrogen flow rate of 20,000 SCF/T of coal. The reaction temperature was 850° F. and the nominal residence time was 38 min. The reaction product distribution obtained was as shown in Table 5. The conversion of coal was 81.9% and the oil yield was 20.4% based on maf coal. The sulfur content of the SRC was 0.5% and the hydrogen consumption was 0.91 wt % of maf coal.

EXAMPLE 6

This example illustrates the catalytic effect of unactivated zinc sulfide concentrate in a coal liquefaction reaction. The coal and solvent feed slurry described in Example 5 was processed in the same reactor described in Example 5. Two different temperatures 825 and 850° F. were used in Runs 6A and 6B, respectively. zinc sulfide concentrate, without activation, having the composition shown in Table 1 was added at a high concentration level of 10.0 wt % of slurry. The product distribution obtained are shown in Table 10. Conversion of coal and oil yield were higher both at 825 and 850° F. temperatures in the presence of unactivated zinc sulfide than shown in Example 5, but lower than Example 4. Hydrogen consumption was significantly higher with unactivated zinc sulfide than without it (see Example 5).

EXAMPLE 7

This example illustrates the reaction of coal from a different source without any additives. The slurry was comprised of Kentucky Elkhorn #2 coal having the composition shown in Table 6 and a process solvent having the elemental composition and boiling point distribution shown in Tables 2 and 3, respectively. A coal oil slurry (70 wt % solvent+30 wt % coal) was passed into a one-litre continuous stirred tank reactor at a total pressure of 2000 psig and a hydrogen flow rate of 18,900 SCF/T of coal. The reaction temperature was 825° F. and the nominal residence time was 35 min. The reaction product distribution obtained was as shown in Table 5. The conversion of coal was 85.3% and the oil yield was 12.2% based on moisture-ash-free (maf) coal. The sulfur content of the residual hydrocarbon fraction (SRC) was 0.61 percent and the hydrogen consumption was 0.64 wt % of maf coal.

EXAMPLE 8

This example illustrates the catalytic effect of unactivated zinc sulfide concentrate at a very low concentration level. The coal and solvent feed slurry described in Example 7 was processed at the same reaction conditions described in Example 7. Unactivated zinc sulfide concentrate was added at a very low concentration level of 1.0 wt % of slurry. The product distribution obtained are shown in Table 5. Conversion of coal was similar to that shown in Example 7, but oil yield was considerably higher than shown in Example 7. Hydrogen consumption was significantly lower than shown in Example 7.

TABLE 5

| CONVERSION AND PRODUCT DISTRIBUTION ON MAF COAL | | | | | | | | |
|---|---|---|---|---|---|---|---|---|
| | ELKHORN #3 COAL | | | | | | ELKHORN #2 COAL | |
| EXAMPLE NO. | #2 | #3 | #4 | #5 | #6A | #6B | #7 | #8 |
| Feed Composition Solvent/Coal/Catalyst (%) | 67/33/0 | 60/30/10 | 60/30/10 | 70/30/10 | 60/30/10 | 60/30/10 | 70/30/0 | 69/30/1 |
| Catalyst - None = N, Unactivated = U, Activated = A | N | U | A | N | U | U | N | U |
| Temp., °F. | 850 | 850 | 850 | 850 | 825 | 850 | 825 | 825 |
| Time, Min. | 60 | 60 | 60 | 38 | 41 | 39 | 35 | 37.3 |
| Pressure, psig | 1,250* | 1,250* | 1,250* | 2,000$^t$ | 2,000$^t$ | 2,000$^t$ | 2,000$^t$ | 2,000$^t$ |
| $H_2$ Flow, Rate, SCF/T | — | — | — | 20,000 | 26,4000 | 24,000 | 18,900 | 23,500 |
| Product Distribution, wt % MAF Coal | | | | | | | | |
| HC | — | — | — | 6.8 | 5.8 | 8.9 | 5.2 | 4.3 |
| CO, $CO_2$ | — | — | — | 1.0 | 1.4 | 1.5 | 0.7 | 1.0 |
| $H_2S$ | — | — | — | 0.2 | 0.2 | 0.2 | 0.3 | 0.2 |
| Oil | 16 | 27 | 41 | 20.4 | 27.3 | 29.3 | 12.2 | 23.0 |
| Asphaltene | 48 | 43 | 30 | 29.2 | 24.1 | 22.3 | 21.2 | 18.5 |
| Preasphaltene | 13 | 14 | 25 | 25.4 | 27.3 | 27.5 | 44.2 | 36.8 |
| I.O.M. | 23 | 16 | 4 | 15.8 | 11.2 | 7.6 | 14.7 | 14.7 |
| Water | — | — | — | 1.2 | 2.7 | 2.7 | 1.5 | 1.5 |
| Conversion | 77 | 84 | 96 | 81.9 | 88.8 | 92.4 | 85.3 | 85.3 |
| Hydrogen Consumption wt % MAF Coal | — | — | — | 0.91 | 1.43 | 1.93 | 0.64 | 0.27 |
| SRC Sulfur | — | — | — | 0.50 | 0.65 | 0.55 | 0.61 | 0.76 |
| Reactor (TB) (CSTR) | TB | TB | TB | CSTR | CSTR | CSTR | CSTR | CSTR |

*at 77° F., t at reaction conditions
TB = tubing bomb
CSTR = continuously stirred tank reactor

TABLE 6

| Analysis of Elkhorn #2 Coal | Weight % |
|---|---|
| Proximate Analysis | |
| Moisture | 1.55 |
| Dry Ash | 6.29 |
| Ultimate Analysis | |
| C | 77.84 |
| H | 5.24 |
| O | 7.20 |
| N | 1.75 |
| S | 1.08 |
| Distribution of Sulfur | |
| Total Sulfur | 1.08 |
| Sulfate Sulfur | 0.04 |
| Pyritic Sulfur | 0.25 |
| Organic Sulfur | 0.79 |

As can be seen in a comparison of the varions runs of the examples listed in Table 5, oil production is extremely high in Example No. 4 in which activated zinc sulfide is utilized as a catalyst to produce liquid oils from a solid coal feed material. In addition, the overall conversion is significantly higher than all other runs, either in uncatalyzed examples or examples using a zinc sulfide catalyst which has not been activated.

The present invention has been described with reference to a tubing bomb or small continuous tank reactor. However, it is understood that the invention could be practiced on a commercial level in a continuous mode wherein coal slurry is continuously passed into a reaction zone and deactivated catalyst and coal products are removed continuously from said zone. In such a large scale process, the feed slurry comprising process solvent, particulate coal and activated zinc sulfide catalyst in the presence of hydrogen is fed through a preheater stage which adjusts the temperature to process conditions and then the material is fed into a reactor commonly referred to as a dissolver. The main liquefaction or solvent refining reactions of the coal feedstock as it is transformed into oil and solid solvent refined coal (SRC) occurs in the dissolver. The processed and refined slurry, as a product, passes from the dissolver into a flash separator where an overhead distillate stream is removed. The resulting slurry can be separated into distillate boiling less than about 850° F. and a residual material containing the ash plus undissolved particulate minerals, spent catalyst and amorphous forms of carbon. The solids can be separated from the bulk of the product by either filtration or by solvent extraction techniques such as critical solvent deashing.

Although the present invention has been exemplified by the utilization of a specific zinc sulfide concentrate and a particular process solvent and feed coal, it is understood that the scope of the invention should not be limited to the specific examples but rather should be ascertained by the claims which follow.

1. In a process for the liquefaction of solid carbonaceous material at elevated temperature and pressure in the presence of a solvent for the carbonaceous material, hydrogen and a hydrogenation catalyst to produce a predominantly liquid product, the improvement comprising the use of an activated zinc sulfide hydrogenation catalyst which is activated by subjecting preformed zinc sulfide to a hydrogenation atmosphere comprising substantially hydrogen at up to 900° F. in solvent for the carbonaceous material but in the absence of said carbonaceous material.

2. In a process for the solvent refining of coal at elevated temperature and pressure in the presence of a coal solvent, hydrogen and a hydrogenation catalyst to produce a predominantly liquid product, the improvement comprising conducting the solvent refining reaction in the presence of an activated zinc sulfide hydrogenation catalyst wherein a preformed zinc sulfide catalyst is activated in a hydrogenation atmosphere comprising substantially hydrogen at up to 900° F. in a coal solvent in the absence of the coal feed material.

3. The process of claim 1 or 2 wherein the temperature of the activation stage is 500° to 900° F.

4. The process of claim 1 or 2 wherein the activation stage is conducted at a pressure in the range of 50–5000 psig.

5. The process of claim 1 or 2 wherein the zinc sulfide is sphalerite.

6. The process of claim 1 or 2 wherein the zinc sulfide catalyst is present in a range of from 0.1 to 10 wt %.

* * * * *